US010934040B2

(12) United States Patent
Herranen et al.

(10) Patent No.: US 10,934,040 B2
(45) Date of Patent: Mar. 2, 2021

(54) SEALING LABEL AND METHOD OF SEALING A PACKAGE

(71) Applicant: UPM Raflatac Oy, Tampere (FI)

(72) Inventors: Jari Herranen, Tampere (FI); Pasi Lehtonen, Nokia (FI); Markku Pietarinen, Tampere (FI); Jari Hirvonen, Vuorentausta (FI)

(73) Assignee: UPM RAFLATAC OY, Tampere (FI)

( * ) Notice: Subject to any disclaimer, the term of this patent is extended or adjusted under 35 U.S.C. 154(b) by 169 days.

(21) Appl. No.: 16/208,969

(22) Filed: Dec. 4, 2018

(65) Prior Publication Data

US 2019/0180649 A1 Jun. 13, 2019

(30) Foreign Application Priority Data

Dec. 8, 2017 (FI) ..... 20176098

(51) Int. Cl.

| | |
|---|---|
| ***B65B 51/04*** | (2006.01) |
| ***G09F 3/03*** | (2006.01) |
| ***G09F 3/00*** | (2006.01) |
| ***G09F 13/20*** | (2006.01) |
| *G09F 3/02* | (2006.01) |

(52) U.S. Cl.

CPC ..... *B65B 51/04* (2013.01); *G09F 3/0292* (2013.01); *G09F 3/0294* (2013.01); *G09F 3/0341* (2013.01); *G09F 3/0376* (2013.01); *G09F 13/20* (2013.01); *G09F 2003/023* (2013.01); *G09F 2003/0257* (2013.01); *G09F 2003/0272* (2013.01); *G09F 2003/0277* (2013.01)

(58) Field of Classification Search

CPC .... G09F 3/0294; G09F 3/0341; G09F 3/0376; B65D 5/0236; B65D 5/4212; B65D 5/4216; B65D 5/425; B65D 5/4233

USPC ..... 53/415, 136.3–136.5

See application file for complete search history.

(56) References Cited

U.S. PATENT DOCUMENTS

| | | | | |
|---|---|---|---|---|
| 5,605,738 | A * | 2/1997 | McGinness et al. | G09F 3/0292 250/365 |
| 5,658,648 | A | 8/1997 | Doerr et al. | |
| 6,612,494 | B1 * | 9/2003 | Outwater | G06K 19/06009 235/462.01 |
| 9,291,559 | B2 * | 3/2016 | Hussain et al. | G06K 19/14 |
| 9,367,849 | B1 * | 6/2016 | Smith et al. | G06Q 30/0185 |
| 9,501,958 | B2 * | 11/2016 | Pietarinen et al. | G09F 3/0341 |

(Continued)

FOREIGN PATENT DOCUMENTS

| | | | | |
|---|---|---|---|---|
| DE | 4236393 | A1 * | 6/1998 | G09F 3/0341 |
| DE | 102015014039 | A1 * | 5/2017 | G09F 3/0341 |

(Continued)

*Primary Examiner* — Stephen F. Gerrity

(74) *Attorney, Agent, or Firm* — Cantor Colburn LLP

(57) ABSTRACT

Sealing a package with a visually transparent sealing label is described. The visually transparent sealing label contains an ultraviolet blocking component to prevent transmission of ultraviolet radiation through the label to the surface of the package. The package comprises an activatable component that upon excitation with ultraviolet radiation emits luminescence. The presence of the sealing label on the package may be verified by illuminating the sealing label with ultraviolet radiation and by observing whether the level of luminescence from the package material under the sealing label is lower than a limit value.

8 Claims, 5 Drawing Sheets

(56) References Cited

U.S. PATENT DOCUMENTS

| | | | | |
|---|---|---|---|---|
| 2002/0146546 | A1* | 10/2002 | Cooley | G09F 3/0292 428/195.1 |
| 2006/0011504 | A1* | 1/2006 | Gosebruch et al. | G09F 3/00 206/459.5 |
| 2007/0001011 | A1* | 1/2007 | Selinfreund et al. | G06K 19/06009 235/454 |
| 2010/0208313 | A1* | 8/2010 | Horgan et al. | G03H 1/0252 359/2 |
| 2013/0062537 | A1* | 3/2013 | Ebert | G06K 19/06009 250/459.1 |
| 2013/0089721 | A1* | 4/2013 | Paolilli et al. | B32B 7/12 428/216 |
| 2013/0239874 | A1 | 9/2013 | Smith et al. | |
| 2014/0008441 | A1* | 1/2014 | Huynh | G09F 3/0294 235/468 |
| 2015/0294602 | A1* | 10/2015 | Read | G09F 3/0291 428/216 |
| 2016/0180747 | A1* | 6/2016 | Pietarinen et al. | G09F 3/0292 206/438 |
| 2017/0323588 | A1* | 11/2017 | Marchesano | G09F 3/0341 |
| 2018/0113070 | A1* | 4/2018 | Kerschner et al. | G01N 21/956 |

FOREIGN PATENT DOCUMENTS

| | | | | |
|---|---|---|---|---|
| EP | 1850308 | A2 | 10/2007 | |
| EP | 1985677 | | 10/2008 | |
| JP | 2009023100 | A | 2/2009 | |
| JP | 2012203161 | | 10/2012 | |
| WO | WO-2017112507 | A2 * | 6/2017 | G09F 3/0292 |

* cited by examiner

SEALING LABEL AND METHOD OF SEALING A PACKAGE

CROSS-REFERENCE TO RELATED APPLICATIONS

This application claims the benefit of Finnish Patent Application No. 20176098, filed Dec. 8, 2017, which is incorporated by reference herein in its entirety.

FIELD

Some variations relate to a combination of a sealing label and a package. Some variations relate to method of attaching a sealing label onto a package. The sealing label may include one or more anti-tampering features.

BACKGROUND

An opening joint of a package may be sealed with a label. Such sealing label may be visually transparent so that the sealing does not visually interfere with the overall appearance of the package.

For anti-tampering, the sealing label may be attached to the package in such a way that the package cannot be opened without damaging the package or without damaging the label. The presence of an intact sealing label on the package may be interpreted to indicate that the package has not been tampered. The presence of an intact sealing label on the package may be interpreted to indicate e.g. that the original contents of the package has not been replaced with a falsified product.

Pharmaceutical packaging is one area where stringent requirements exist that every package is properly sealed before the product is provided for end use such as retailing. Additionally, pharmaceutical packages are typically small or rather moderate sized and therefore have limited surface area to be occupied with sealing label due to the fact that the surface area is also occupied with obligatory visual product information as well as other, typically brand related information. A pharmaceutical package may be, for example, a cardboard box having white basic colour. Further, because the end user of the product may have some physical inabilities, the sealing label may need to be easy to open after purchase, but yet to provide confirmation that the package has not been tampered prior to the end use.

The above and other requirements may lead to solution that the sealing label needs to be made fully or in most part visually transparent, small in size and located to cover only a certain part of the seam of the opening joint of the package. This then creates certain challenges in dispensing the label correctly on the package and ensuring the every package has been properly sealed with a label when leaving the packaging line. In order to make the sealing label visually transparent and also easily conformable (flexible) over the seam of the package, rather thin filmic carrier materials need to be used and these thin materials may create further challenges in the label dispensing phase especially when high speed dispensing is used, where the release of the labels from the release liner becomes critical. Thus, confirming with high certainty that the package has been correctly sealed with a transparent label becomes technically rather challenging.

In prior art, methods based on ultraviolet excited luminescence has been used in corresponding situations for detecting label presence on the package. In this technique, suitable luminescence pigment is arranged on the label, wherein when illuminating the package with ultraviolet light, the luminescence from the label verifies the existence and correct location of the transparent label on the package. This technique requires use of special ultraviolet luminescent pigments in the label, which is certain applications may be not preferable from the chemical contamination or migration point of view, as well as inducing extra cost in the manufacturing of the labels.

Therefore, there still exists a need to develop better techniques and labels to seal certain type of packages with transparent or mainly transparent sealing labels.

SUMMARY

Some variations may relate to a sealing label. Some variations may relate to a combination of a package and a sealing label. Some variations may relate to a method of attaching a sealing label to a package. Some variations may relate to a method of checking whether a package has been provided with a sealing label. Some variations may relate to a sealing label including one or more anti-tampering features.

The sealing label may comprise:

a visually transparent carrier layer, and a visually transparent adhesive layer, wherein at least of one the carrier layer or adhesive layer contains or carries ultraviolet radiation blocking component to prevent ultraviolet radiation passing through the label.

According to an aspect, there is provided a combination of a sealing label and a package, wherein the label has been attached to the package such that an opening joint of the package is located between two attachment regions of the label, the label comprising:

a visually transparent carrier layer, and a visually transparent adhesive layer, wherein at least of one the carrier layer or adhesive layer contains or carries ultraviolet blocking component to prevent ultraviolet radiation passing through the label, and the package comprising an activatable component that upon excitation with ultraviolet radiation emits luminescence.

According to an aspect, there is provided a method of attaching a sealing label onto a package, wherein the label is attached to the package such that an opening joint of the package is located between two attachment regions of the label, the label comprising:

a visually transparent carrier layer, and a visually transparent adhesive layer, wherein at least of one the carrier layer or adhesive layer contains or carries ultraviolet blocking component to prevent ultraviolet radiation passing through the label, and the package comprising an activatable component that upon excitation with ultraviolet radiation emits luminescence, wherein the existence of the sealing label on the package is verified by illuminating the sealing label on the package with ultraviolet radiation and observing the relative lack of luminescence from excited by said ultraviolet illumination from the sealing label and from the package material under the sealing label.

The current invention aims to solve the problem that has become very evident when using visually transparent labels on packages that themselves in the packaging substrate material or in any additional layers such as package coatings, protective sheets or other labels comprise activatable components that will produce luminescence when excited with ultraviolet radiation. This phenomena in practise hinders the use of the prior art ultraviolet excitation methods to identify the existence and/or location of the label on the package because when illuminated with ultraviolet, the label allows the ultraviolet radiation to pass through the labels and excite the luminescence in the package material itself regardless the existence or non-existence of the label. Then the excited and typically visual luminescence passes back through the visually transparent label and no significant difference can be identified in the level or the luminescence with the label in place or not.

In this invention, this problem is solved by adding at least one visually transparent but ultraviolet blocking component to the label so that the label will not pass ultraviolet radiation in significant amounts onto the package material and thus the label prevents the luminescence to become created in the package material. This allows high luminescence contrast to become identified depending the label being present in the measurement location or not.

The sealing label according to the invention may be attached to a package, which is a package for pharmaceutical products. Such package may comprise varnished cardboard which typically for improved visual appearance contains optical brightener agents (OBAs). The OBA contained in the packaging material itself may emit luminescence when illuminated with ultraviolet radiation and thus interfere with the ultraviolet luminescence based identification of the transparent sealing label. The OBA containing package may also be other than a pharmaceutical package, for example, the package may be a sealed letter or envelope or a logistic package that needs to be sealed to identify unauthorized opening.

The label may be used as a tamper-evident seal. The further properties of the tamper-evident label may be selected such that it is difficult or impossible to separate the label from the package, for example from varnished cardboard or paper material of the package without damaging both the label and the package. Separating the label from the package may cause detectable damage both to the label and to the package. Separating the label from the package may, at a very high probability, cause visually detectable damage both to the label and to the package. This makes unauthorized re-use of the label and the package more difficult. An unaltered label on the surface of the package may be interpreted to be an indication that the package has not been tampered.

The properties of the tamper-evident label may be selected such that separating the label away from the package causes detectable irreversible stretching of the label itself and detectable tearing of the package surface material. Said stretching and tearing may be visually detectable. Separating the label from the package may inevitably cause visual indications to the label and to the package, which may make unauthorized re-use of the label and the package more difficult. In an embodiment, separating the label from a package may damage the surface of the package. In an embodiment, separating the label from a package may cause so severe damage to the package that the package cannot be used again.

The sealing label of the invention may be used in any type of packages, which packages comprise some radiation activatable component or components that can be excited to provide luminescence upon excitation with ultraviolet radiation, and where existence or location of the sealing label would need to be verified during packaging or in later phases of the value chain. Such packages and product may include, but are not limited to high end cosmetics, alcohols, other chemical or mechanical products, products with limited warranty if packages are opened, letters, envelopes, packages used in postal packets or other logistic packets, high end consumer products, clothing related or any situations where the sealing label is used on materials that could with their own ultraviolet luminescence interfere with the ultraviolet based verification of the sealing label existence or positioning.

BRIEF DESCRIPTION OF THE DRAWINGS

In the following examples, several variations will be described in more detail with reference to the appended drawings, in which.

DETAILED DESCRIPTION

Figure 1:
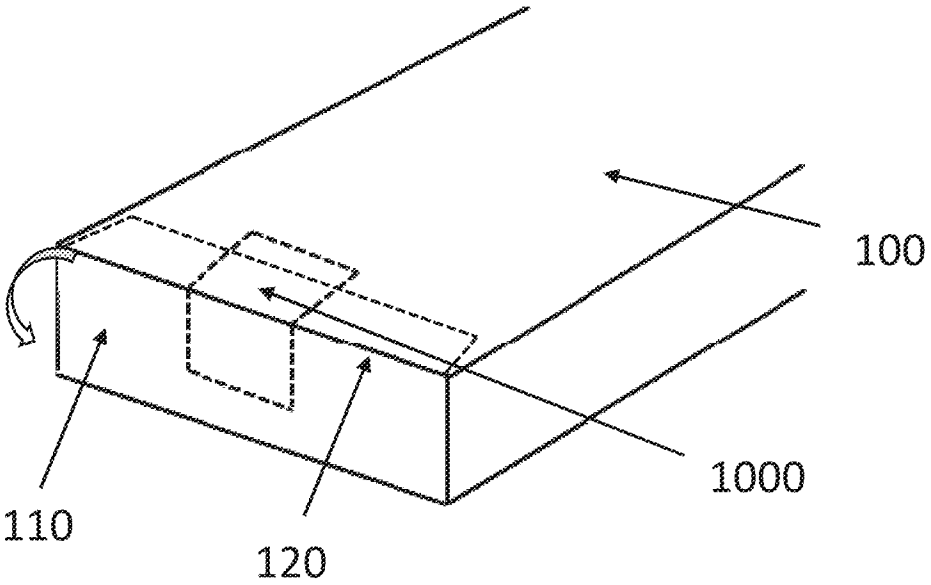
FIG. 1 shows, by way of example, in a three dimensional view, a combination of a package 100 and a sealing label 1000.

Referring to FIG. 1, an opening joint 110 of a package 100 may be sealed with a label 1000. The label may be visually transparent so that the sealing does not visually interfere with the overall appearance of the package or does not block view onto any markings on the package and left under the label 1000.

The size and location of the label 1000 over the seam 120 of the opening joint 110 may vary and the label may have been selected to have a circular, oval, rectangular or other suitable shape. Further, even if being made of visually transparent materials, the label 1000 may itself comprise one or more visual markings which represents, for example, a trade mark or other information associated with the packaged product. Such visual markings can be normally printed on any surface or layer of the label 1000, and they may also include special markings, which may be e.g. a hologram or other type of markings difficult to replicate and adding security or anti-tampering features into the label 1000.

For anti-tampering, the label 1000 may be attached to the package 100 such that package cannot be opened without damaging the package or without damaging the label. The presence of an intact sealing label 1000 on the package 100 may be interpreted to indicate that the package has not been tampered. The presence of an intact sealing label on the package may be interpreted to indicate e.g. that the original contents of the package has not been replaced with a falsified product.

Figure 2:
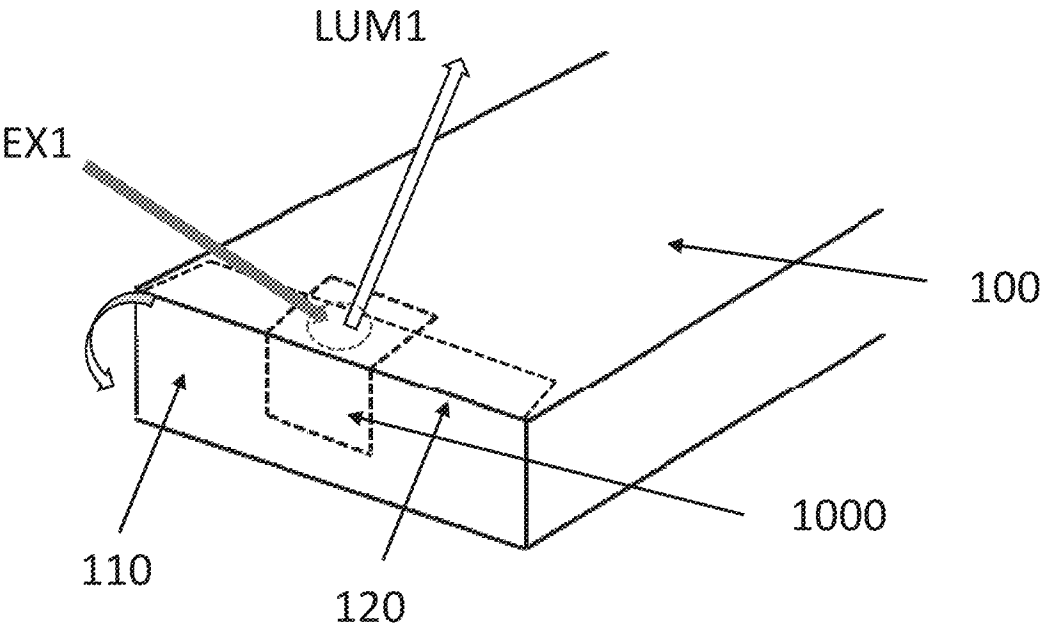
FIG. 2 shows, by way of example, in a three dimensional view, a sealing label 1000 being probed with ultraviolet excitation EX1 producing luminescence LUM1.

Referring to FIG. 2, the visually transparent sealing label 1000 is arranged over the seam 120 of the opening joint 110 of the package 100. When excited with ultraviolet radiation EX1 luminescence LUM1 is generated in the material of package 100 in case the sealing label 1000 is of prior art type of design and without capability to block the ultraviolet radiation and the materials of the package 100 contain component or components that can be excited with ultraviolet to create luminescence.

The known prior art solutions to verify the existence or location of transparent labels are based on adding ultraviolet luminescent pigment materials on the label 1000 itself. Such approach is successful only if the package 100 itself does not contain materials that could be excited with the ultraviolet radiation. This is the case, for example, for glass bottles or glass ampoules which are often used also in pharmaceutical applications. In such situations the prior art type luminescent labels 1000 have been successfully used even when the labels have been produced being transparent. The only luminescence becomes created in the label as the package itself does not comprise any luminescence materials.

However, for other packaging materials containing ultraviolet excitable components, such prior art approach is not satisfactory. As an example, one of packaging materials challenging in this respect is white cardboard containing optical brightener agents to improve the visual appearance of the package. The combination of such small sized packages that also need to be sealed with small sized visually transparent labels exists in pharmaceutical, i.e. medicine packaging.

In addition to optical brightener agents (OBAs), there are also other ultraviolet excitable components such as fluorescent brightening agents (FBAs), or fluorescent whitening agents (FWAs). These all are chemical compounds that absorb light in the ultraviolet and violet region (usually 340-370 nm) of the electro-magnetic spectrum, and re-emit light in the visible blue region (typically 420-470 nm) by fluorescence or luminescence. The excitation wavelength range of OBAs, FBAs or FWAs overlap typically with the ultraviolet A wavelengths (UVA) in the range from 320 nm up to 400 nm.

The terms "luminescence", "luminescent material, "luminescent component" or "luminescent agent" and words of similar import as used in this specification are used to indicate material which will emit radiant energy when exposed to ultraviolet light. Fluorescent and phosphorescent materials are included within the broad term "luminescent" Characteristically, luminescent materials will luminesce, that is, give off visible light radiation, when energized by a source of ultraviolet light. The decay time, or relaxation time, or half-life of the phosphorescent materials must be short enough for the luminescence to have a readily measurable emission component. Fluorescent emission is usually understood as a short-lived period of light emission compared to phosphorescence, which is more long-lived and continues certain time after ultraviolet excitation has been ended.

These aforementioned additives OBA, FBA or FWA are used to enhance the appearance of colour of, for example, fabric, paper, cardboard, different type of coating or paints by inducing a "whitening" effect; they help to make intrinsically yellow/orange materials look less so by compensating the deficit in blue and purple light reflected by the material with the blue and purple optical emission of the fluorophore or phosphor component. The most common classes of compounds with this property are the known as various stilbenes and their derivatives.

Commercially available ultraviolet inspection methods are typically based on the use of sensors that provide a light output in the near ultraviolet range (~UVA range), from about 320 to 380 nm, which heavily overlaps with the excitation wavelengths of typical OBA, FBA or FWA materials. These sensors may provide various light spot sizes ranging, for example, from one to 10 mm and may operate at sensor-to-target distances of 25 to 300 mm. When the target material has a luminescent characteristic it will emit visible light when positioned in the sensor's light spot. This visible light is then measured by the sensor and an output signals is provided to process equipment to indicate the presence of the target material. Since the sensor sample rates may be up to kilohertz (kHz), this combined with small spot size allows high spatial resolution to be achieved and high-speed processes to be monitored on the manufacturing line.

Figure 3:
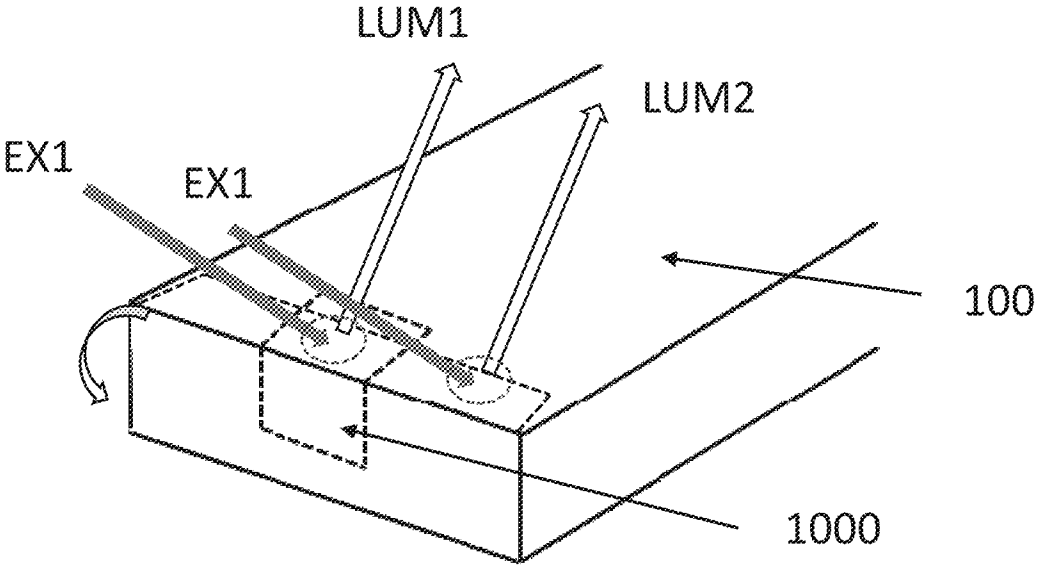
FIG. 3 shows, by way of example, in a three dimensional view, the neglible difference of luminescence LUM1 and LUM2 when excited with ultraviolet excitation EX1 in presence of the label or without presence of the label.

FIG. 3. describes schematically the challenge when trying to verify the existence of label 1000 on package 100. In case the material of package 100 contains OBA, FBA or FWA materials, then for a transparent, non-UV blocking label 1000 the signals LUM1 and LUM2 may be of similar, or only slightly different magnitude. Even in the case that materials of label 1000 has been further added with traces of OBA, FBA, FWA to make the label itself to create luminance, the difference between signals LUM1 and LUM2 may not become highly obvious.

It should be understood that in practise for measurements performed in typical production line environment, the difference in signals LUM1:LUM2 (or LUM2:LUM1) for reliable identification of the label may need to be at least 1:1.5, 1:2, 1:5 or even in the excess of 1:10. Such high difference in signals LUM1 and LUM2 would eliminate effectively errors in identification and compensate for any tolerances in the measurement device or optical properties of the package or the label.

Figure 4:
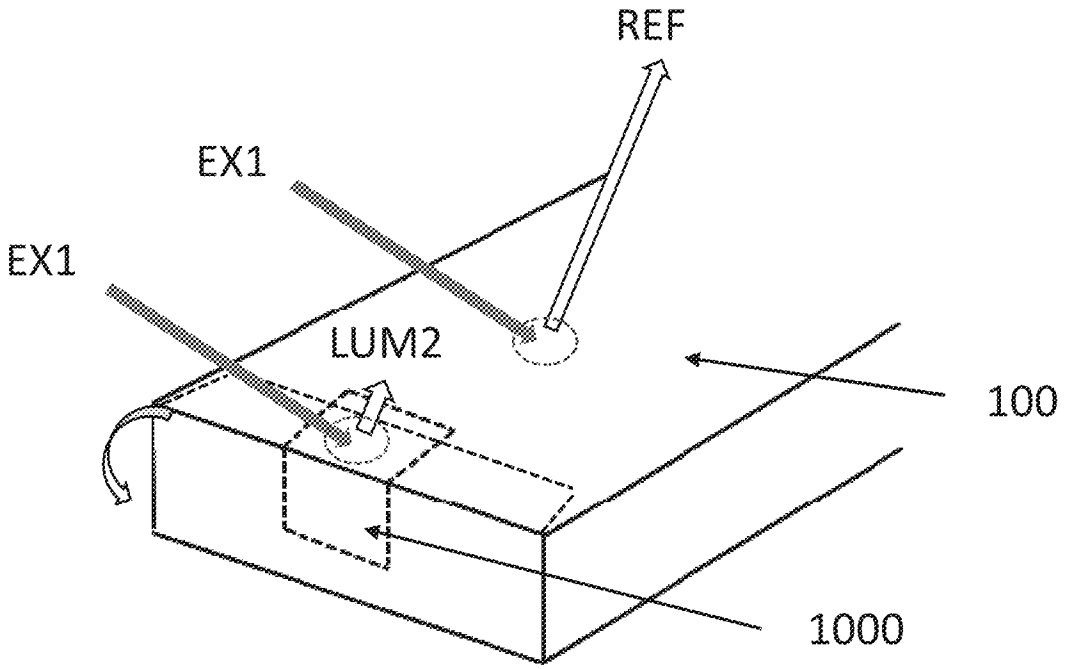
FIG. 4 shows, by way of example, in a three dimensional view, measuring a reference value of luminescence REF to be compared with the luminescence value LUM2 from the location of the ultraviolet blocking label 1000.

FIG. 4 illustrates now schematically the identification method according to the invention. Label 1000 sealing the package 100 has now been equipped with ultraviolet blocking capability, which may block at least 30%, 50%, 75% or even in the excess of 95% of the ultraviolet radiation between 340-370 nm or 320-380 nm or UVA wavelength range. This in turn effectively prevents luminance LUM2 being created by the OBA, FBA, FWA or similar materials contained in the package 100. Therefore, if a reference luminescence measurement REF is performed from the package at the location without a label, the difference in magnitude of the signals LUM2 and REF is significant and easy to identify.

Because in this invention the existence or location of the label 1000 on the package 100 is determined primarily based on the relative lack (non-existence or small magnitude) of the luminescence signal LUM2 on the location of the label 1000, in order to continuously verify that the measurement system is working correctly, a reference signal REF at the location without a label may be measured occasionally or in synchrony for each package. Reference signal REF can be used to verify that the package 100 was present for the measurement (generating expected level of luminescence) and that the measurement system is working correctly even no or low signal levels are measured for label luminescence LUM2. Therefore, according to one embodiment of the invention the measurement is performed as such differential measurement.

One important technical benefit of the invention is that existing ultraviolet sensor systems based on ultraviolet excitation and measuring luminescence can be easily converted for the use according to the invention. In principle the only change required is to adjust the triggering indicating existence of the label to be "inverted", in other words lack of signal or low level signals indicate existence of label and high level signals indicate a missing labels. The spot type measurement systems can be readily modified to make measurements synchronized to the movement of the packages on the production line and thus to provide LUM2 and REF measurements from individual packages.

The activatable component of the package material under the label may provide a reduced luminescence value when the label is illuminated with ultraviolet radiation, due to the ultraviolet blocking capability of the label.

A label-free reference location of the package material may provide a reference luminescence value when the package material is illuminated with the ultraviolet radiation.

The reduced luminescence value may be substantially lower than the reference luminescence value. The reduced luminescence value may be e.g. smaller than 30%, smaller than 50%, smaller than 75%, or even smaller than 95% of the reference luminescence value, in a situation where the label and the reference location are illuminated with the ultraviolet illumination.

The package material under the sealing label may be substantially similar to the package material at the label-free reference location. In an embodiment, the activatable component (e.g. OBA, FBA, FWA) may be substantially evenly distributed over the outer surface area of the package.

The method may comprise:

providing a package such that the material of the package comprises an activatable component that upon excitation with ultraviolet radiation emits luminescence, providing a sealing label, which comprises a visually transparent carrier layer and a visually transparent adhesive layer, wherein at least one the carrier layer or adhesive layer contains or carries ultraviolet blocking component to prevent ultraviolet radiation passing through the label, attaching the label to the package, illuminating a measurement location of the package with ultraviolet radiation, measuring luminescence excited by the ultraviolet illumination from the measurement location, and identifying existence and/or location of the label based on a difference between the measured luminescence and a reference value.

The method may comprise determining whether the sealing label is present in the measurement location based on the difference between the measured luminescence and a reference value.

The sealing label may be determined to be present e.g. in a situation where the measured luminescence is lower than a first limit value.

The method may comprise measuring a reference luminescence value by performing a reference luminescence measurement at a location of the package without a label, wherein the first limit value may be e.g. lower than 30%, lower than 50%, lower than 75%, or even lower than 95% of the reference luminescence value.

The method may comprise measuring luminescence excited by the ultraviolet illumination from the measurement location. The sealing label may be determined to be missing or not in a correct position in a situation where the measured luminescence is higher than a second limit value.

The method may comprise measuring a label-free luminescence value by performing a reference luminescence measurement at a label-free location. The method may comprise determining based on the measured label-free luminescence value whether the package is present at the label-free location or not, by comparing the measured label-free luminescence value with a predetermined value. The method may comprise determining that the package is present e.g. in a situation where the measured label-free luminescence value is within a predetermined range of values. The method may comprise detecting that the package is missing when measured label-free luminescence value is substantially lower than a predetermined value.

FIGS. 5*a*-5*e* illustrate in schematic cross n views some potential structures of visually transparent labels 1000 with ultraviolet blocking capability according to the invention.

Figure 5A:
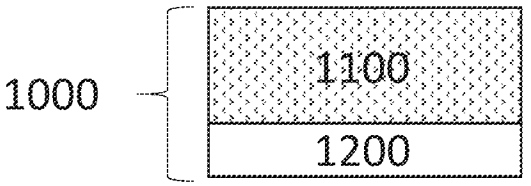
FIGS. 5*a*-5*e* show, by way of examples, in a cross section views, the some potential structures of the sealing label 1000 according to the invention.

In FIG. 5*a* filmic label carrier material 1100 has been introduced with ultraviolet blocking component. Adhesive 1200 has been left unmodified in this respect.

Figure 5B:
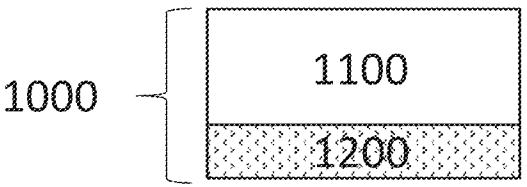

In FIG. 5*b* the carrier material 1100 is normal filmic material without ultraviolet blocking component but instead adhesive 1200 is introduced with material blocking ultraviolet radiation.

Figure 5C:
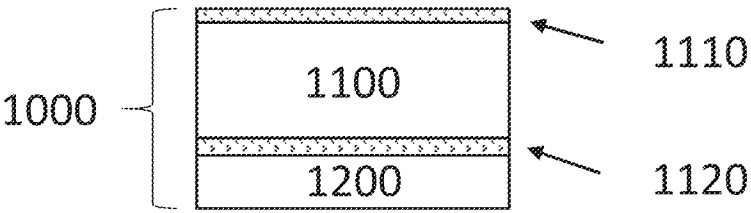
Figure 5D:
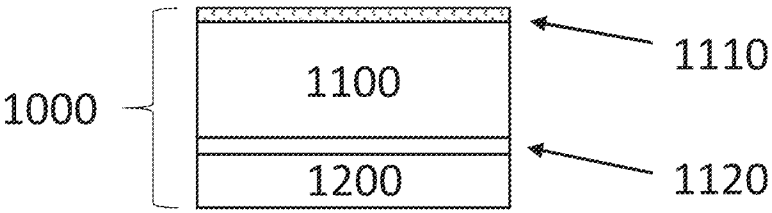

In FIG. 5*c* and FIG. 5*d* the ultraviolet blocking is introduced in the top coating layer 1110 and/or in the primer layer 1120. These layers may be, for example, lacquer or varnish layers containing ultraviolet blocking components. Alternatively, the carrier material 1100 may also be over laminated with an additional filmic layer (not shown) having been treated to block ultraviolet, for example by a suitable further top coat layer. A further possibility is that the carrier material 1100 has been thin film coated to have physical metallic or metal oxide coating layer to block ultraviolet but being very thin allowing the carrier material to be visually transparent.

Figure 5E:
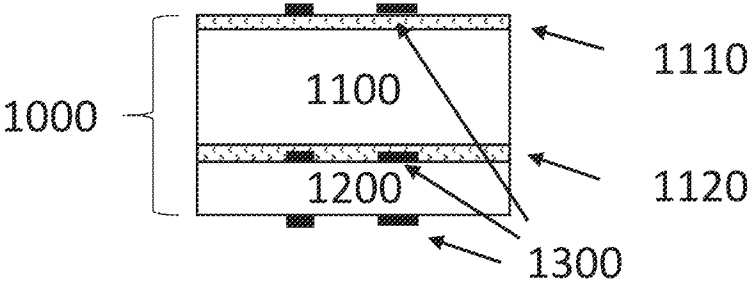

FIG. 5*e* indicates further additional printing 1300 in the label 1000. The printing may be introduced on the top surface of the transparent label structure or also in between the carrier 1100 and adhesive 1200 layers. As one alternative, the printing itself may act as an ultraviolet blocking layer and in this case the label 1000 may be printed in full or in most of its area which such ink, which may be fully or partially visually transparent.

It is to be understood that any combination of the embodiments in FIGS. 5*a*-5*e* is possible to introduce the ultraviolet blocking capability to one or more of the layers of the label 1000. In this specification expressions "layer contains" or "layer carriers" ultraviolet blocking component should be understood widely. That is a layer can, for example, comprise various amounts of one or more ultraviolet blocking substance or agent, or the layer can be coated or treated on its one or more surfaces with such substances or agents which coatings can then be understood themselves as separate layers. The amount and location of the ultraviolet blocking substances or agents may be divided into different layers of the label to achieve the necessary level of blocking.

Further, it should be understood that the label laminate with the carrier 1100 and adhesive 1200 and with the optional release liner (not shown) may be originally manufactured with the ultraviolet blocking capability or alternatively the ultraviolet blocking capability may be added to the existing label laminate later, for example, during the converting of the label laminate at the die-cutter or at the printer. This may be done, for example, by adding the ultraviolet blocking top cot varnish to the laminate before or after converting/printing.

Some examples of possible materials of the label according to the invention.

In one variation, the ultraviolet blocking top coat or primer on the back side of the carrier may individually have coating weight in the range of 0.5-3.0 g/m$^2$.

In one variation, the transparent, clear filmic carrier material may selected from the following materials:

polyethylene terephthalate with thickness of 12-50 micrometers polypropylene with thickness of 25-60 micrometers polyethylene with thickness of 30-70 micrometers acrylate film with thickness of 30-60 micrometers
void security film with thickness of 30-60 mm In variation, the clear adhesive may have a coating weight in the range of 10-35 g/m$^2$ and produced as pressure sensitive adhesive. The chemistry of the adhesive may be selected from the following types:

water dispersion based adhesive
acrylic adhesive
polyurethane adhesive
solid based adhesive
hot melt adhesive
ultraviolet cross linkable adhesive
moisture cross linkable adhesive Ultraviolet blocking may include ultraviolet absorbers, which again may be based on chemical or physical absorbers or combinations therein. Further, ultraviolet absorbers may further be used together with ultraviolet protector molecules that are capable of interfering with and/or preventing the deleterious effects of ultraviolet on materials. Ultraviolet blocking may be arranged to cover any or several of the ultraviolet wavelength ranges: ultraviolet C (UVC 200-290 nm), ultraviolet B (UVB 290-320 nm), and ultraviolet A (UVA 320-400 nm).

Some but not limiting examples of chemical ultraviolet absorbers are the following or their derivatives: aminobenzoates, cinnamates, salicylates, octocrylenes, oxalanilides, ensulizoles, benzophenones, benzotriazoles, oxybenzones, anthranilates, avobenzones, ecamsules, methylene-bis-benzotriazolyl tetramethylbutylphenol (MBBT), triazines such as bis-ethylhexyloxyphenol methoxyphenyl triazine (BEMT) or hydroxybenzotriazoles.

Some but not limiting examples of physical ultraviolet absorbers are: organic microparticles comprising, for example, titanium dioxide or zinc oxide, different type of ultrafine nanomaterials with diameters less than 100 nm, thin film coatings such as metallic, metallic oxide or ceramic thin film coatings.

The above mentioned chemical and physical absorbers may be included in one or more of the layers of the label and one or more absorbers can be used simultaneously in one or more layers to produce the required level of ultraviolet absorption and blockage.

In general, the materials and the thickness of the label may be selected such that the label may be easily bent over a corner to seal the package. Consequently, the label may easily conform to the potentially three-dimensional shape of the package.

The carrier layer 1100 may be easily stretched when pulled by a pulling force. The carrier layer 1100 may be irreversibly stretched when pulled by the pulling force. The elongation of the layer 1100 at break may be e.g. in the range of 350 percent to 800 percent. The carrier layer 1100 may comprise filmic material and the material may be suitable for pharmaceutical use.

The carrier layer 1100 may be produced e.g. by casting. The machine direction (MD) refers to the direction of movement of the film when the film is produced by a production apparatus. The cross machine direction (CD) is perpendicular to the machine direction (MD). The layer 1100 may be produced e.g. such that the layer 1100 is not significantly stretched during said producing or alternatively, the layer 1100 may have been oriented either in MD and/or TD directions.

The composition of the adhesive layer 1200 may be selected such that the adhesive layer 1200 forms a sufficiently strong bond between the carrier layer 1100 and the surface of the package 100.

The adhesive layer 1200 may comprise e.g. a water-based polymer composition or solvent based composition. In an embodiment, the adhesive may be selected such that the adhesive is approved for use in pharmaceutical applications. The adhesive may be selected such that the adhesive is approved for use with foodstuff packages.

The adhesive may be pressure sensitive adhesive. The adhesive may a durable adhesive.

The label may be used as a tamper-evident seal. The properties of the tamper-evident label may be selected such that it is difficult or impossible to separate the label from the package without damaging either the label or the package or both of them. Separating the label from the package may cause detectable damage both to the label and to the package. This may make unauthorized re-use of the label and the package more difficult. An unaltered label on the surface of the package may be interpreted to be an indication that the package has not been tampered.

The label may comprise further anti-tampering features, for example VOID-functionality, which upon removal of the label creates a visual effect indicating that the seal is void. Further, the label may comprise further safety features, such as hologram or other markings that are difficult to replicate by unauthorized parties.

Various aspects of the invention may be illustrated by the following examples:

Example 1

A label for sealing a package, the label comprising:
a visually transparent carrier layer, and
a visually transparent adhesive layer,
wherein at least of one the carrier layer or adhesive layer contains or carries ultraviolet radiation blocking component to prevent ultraviolet radiation passing through the label.

Example 2

A label according to example 1, wherein the carrier layer material is filmic material selected from polyethylene terephthalate, polypropylene, polyethylene or acrylate.

Example 3

A label according to example 1, wherein the adhesive is selected from water dispersion based adhesive, acrylic adhesive, polyurethane adhesive, solid based adhesive, hot melt adhesive, ultraviolet cross linkable adhesive or moisture cross linkable adhesive.

Example 4

A label according to example 1, wherein the label is a pressure sensitive adhesive label.

Example 5

A combination of a sealing label and a package, wherein the label is adhesively attachable to the package such that an opening joint of the package becomes located between two adhesive attachment regions of the label, the label comprising:
a visually transparent carrier layer, and
a visually transparent adhesive layer,
wherein at least of one the carrier layer or adhesive layer contains or carries ultraviolet blocking component to prevent ultraviolet radiation passing through the label, and the package comprising an activatable component that upon excitation with ultraviolet radiation emits luminescence.

Example 6

A combination of a sealing label and a package according to example 5, wherein the sealing label in visually transparent and the activatable component in the package is optical brightener agent (OBA), fluorescent brightening agent (FBA) or fluorescent whitening agent (FWA).

Example 7

A combination of a sealing label and a package according to example 5, wherein the wavelength ranges for the ultraviolet blocking in the label and the excitation of the activatable component in the package overlap each other.

Example 8

A combination of a sealing label and a package according to example 7, wherein the wavelength ranges for the ultraviolet blocking in the label and the excitation of the activatable component both overlap with ultraviolet wavelength range UVA.

Example 9

A method of attaching a sealing label onto a package, wherein the label is adhesively attached to the package such that an opening joint of the package is located between two adhesive attachment regions of the label, the label comprising:

a visually transparent carrier layer, and a visually transparent adhesive layer, wherein at least of one the carrier layer or adhesive layer contains or carries ultraviolet blocking component to prevent ultraviolet radiation passing through the label, and the package comprising an activatable component that upon excitation with ultraviolet radiation emits luminescence, wherein the existence of the sealing label on the package is verified by illuminating the sealing label on the package with ultraviolet radiation and observing the relative lack of luminescence from excited by said ultraviolet illumination from the sealing label and from the package material under the sealing label.

For the person skilled in the art, it will be clear that modifications and variations of the structures and the methods according to the present invention are perceivable. The figures are schematic. The particular embodiments described above with reference to the accompanying drawings are illustrative only and not meant to limit the scope of the invention, which is defined by the appended claims.

The invention claimed is:

1. A method, comprising:

providing a package such that a material of the package comprises an activatable component that upon excitation with ultraviolet radiation emits luminescence, providing a sealing label, which comprises a visually transparent carrier layer and a visually transparent adhesive layer, wherein at least one of the carrier layer or adhesive layer contains or carries an ultraviolet blocking component to prevent ultraviolet radiation passing through the label, attaching the label to the package, illuminating a measurement location of the package with ultraviolet radiation, measuring luminescence excited by the ultraviolet illumination from the measurement location, and identifying existence and/or location of the label based on a difference between the measured luminescence and a reference value of luminescence emitted from a location of the package without a label.

2. The method of claim 1, wherein a first limit value is lower than 50% of the reference value, and wherein the sealing label is determined to be present in a situation where the measured luminescence is lower than the first limit value.

3. The method of claim 1 comprising measuring a label-free luminescence signal by performing a luminescence measurement at a label-free location.

4. The method of claim 1 comprising measuring a label-free luminescence signal by performing a luminescence measurement at a label-free location, and determining based on the measured label-free luminescence signal whether the package is present, by comparing the measured label-free luminescence signal with an expected level of the label-free luminescence signal.

5. A method of attaching a sealing label onto a package, wherein the label is adhesively attached to the package such that an opening joint of the package is located between two adhesive attachment regions of the label, the label comprising:

a visually transparent carrier layer, and a visually transparent adhesive layer, wherein at least of one of the carrier layer or adhesive layer contains or carries an ultraviolet blocking component to prevent ultraviolet radiation passing through the label, the package comprising an activatable component that upon excitation with ultraviolet radiation emits luminescence, the method comprising:

illuminating an area on the package where the sealing label is intended to be located with ultraviolet radiation, observing luminescence excited by said ultraviolet illumination from the area on the package where the sealing label is intended to be located, and in an instance in which the sealing label is at the intended location, verifying the existence of the sealing label based on the relative lack of luminescence excited by said ultraviolet illumination from the sealing label and from the package material under the sealing label.

6. The method of claim 5, wherein the sealing label is visually transparent and the activatable component in the package is selected from the group consisting of optical brightener agent (OBA), fluorescent brightening agent (FBA), and fluorescent whitening agent (FWA).

7. The method of claim 5, wherein an ultraviolet blocking wavelength range of the label overlaps with a wavelength range for excitation of the activatable component in the package.

8. The method of claim 5, wherein an ultraviolet blocking wavelength range of the label overlaps with the ultraviolet wavelength range UVA, and wherein a wavelength range for excitation of the activatable component in the package overlaps with the ultraviolet wavelength range UVA.

* * * * *